US007753714B2

(12) United States Patent
Wu et al.

(10) Patent No.: US 7,753,714 B2
(45) Date of Patent: Jul. 13, 2010

(54) ELECTRICAL ADAPTER ASSEMBLY AND LOADING MEMBER THEREOF

(75) Inventors: Hung-Bin Wu, Taipei Hsien (TW); Nian-Feng Zhen, Shenzhen (CN); Hou-Xin Sun, Shenzhen (CN); Hua-Feng Wu, Shenzhen (CN); Ke-Chen Lin, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/420,805

(22) Filed: Apr. 8, 2009

(65) Prior Publication Data

US 2009/0258513 A1 Oct. 15, 2009

(30) Foreign Application Priority Data

Apr. 10, 2008 (CN) ..... 2008 1 0300939

(51) Int. Cl.
*H01R 13/625* (2006.01)

(52) U.S. Cl. ..... 439/374; 439/76.1; 439/638; 439/620.24; 361/685; 361/679.33

(58) Field of Classification Search ..... 439/374, 439/76.1, 638, 377, 620.24, 620.25; 361/685, 361/679.33, 679.34, 679.35, 679.36, 679.37, 361/679.38, 679.39
See application file for complete search history.

(56) References Cited

U.S. PATENT DOCUMENTS

| | | | | |
|---|---|---|---|---|
| 6,547,576 | B2 * | 4/2003 | Peng et al. | 439/173 |
| 6,648,695 | B1 | 11/2003 | Wu | |
| 6,762,932 | B2 * | 7/2004 | Regimbal et al. | 361/679.33 |
| 7,044,656 | B1 * | 5/2006 | Hofmeister et al. | 385/89 |
| 2002/0094706 | A1 * | 7/2002 | Britton et al. | 439/74 |
| 2003/0112595 | A1 * | 6/2003 | Kwong et al. | 361/685 |
| 2003/0133388 | A1 * | 7/2003 | Syring et al. | 369/75.1 |
| 2005/0038931 | A1 * | 2/2005 | Levy | 710/15 |
| 2007/0008694 | A1 * | 1/2007 | Yang et al. | 361/685 |
| 2007/0153338 | A1 * | 7/2007 | Seo et al. | 358/498 |
| 2008/0266816 | A1 * | 10/2008 | Ni et al. | 361/737 |

* cited by examiner

*Primary Examiner*—Gary F. Paumen
(74) *Attorney, Agent, or Firm*—Frank R. Niranjan

(57) ABSTRACT

An electrical adapter assembly for connecting a first hard disk drive and a second hard disk drive is provided. The electrical adapter assembly includes a connector capable of electrically inserting into the first hard disk drive, a printed circuit board (PCB) module electrically connecting the connector, and a loading member for loading the first hard disk drive. The PCB module includes a chip for controlling data transfer between the first hard disk drive and the second hard disk drive. The loading member includes a base and at least two guiding portions pivotally attached on the base to allow the first hard disk drive to be able to slide between the at least two guiding portions.

14 Claims, 5 Drawing Sheets

ELECTRICAL ADAPTER ASSEMBLY AND LOADING MEMBER THEREOF

BACKGROUND

1. Technical Field

Embodiments of the present disclosure generally relate to connectors, and particularly, to an electrical adapter assembly for hard disk drives.

2. Description of Related Art

Hard disk drives are widely used as mass storage devices in computers. To transfer information/data from a first hard disk drive to a second hard disk drive using a computer, the two hard disk drives must be coupled to a motherboard of a computer and the operating system of the computer must be used to transfer the information/data. After the information/data is transferred and if one of the two hard disk drives is to be used on a second computer, the hard disk drive must be detached from the first computer and coupled to the motherboard of the second computer. As can be seen, this is a tedious and time consuming process.

Therefore, a need exits for providing an electrical adapter assembly that can conveniently and repeatedly connect hard disk drives to each other without interfacing to a motherboard.

DETAILED DESCRIPTION

Figure 1:
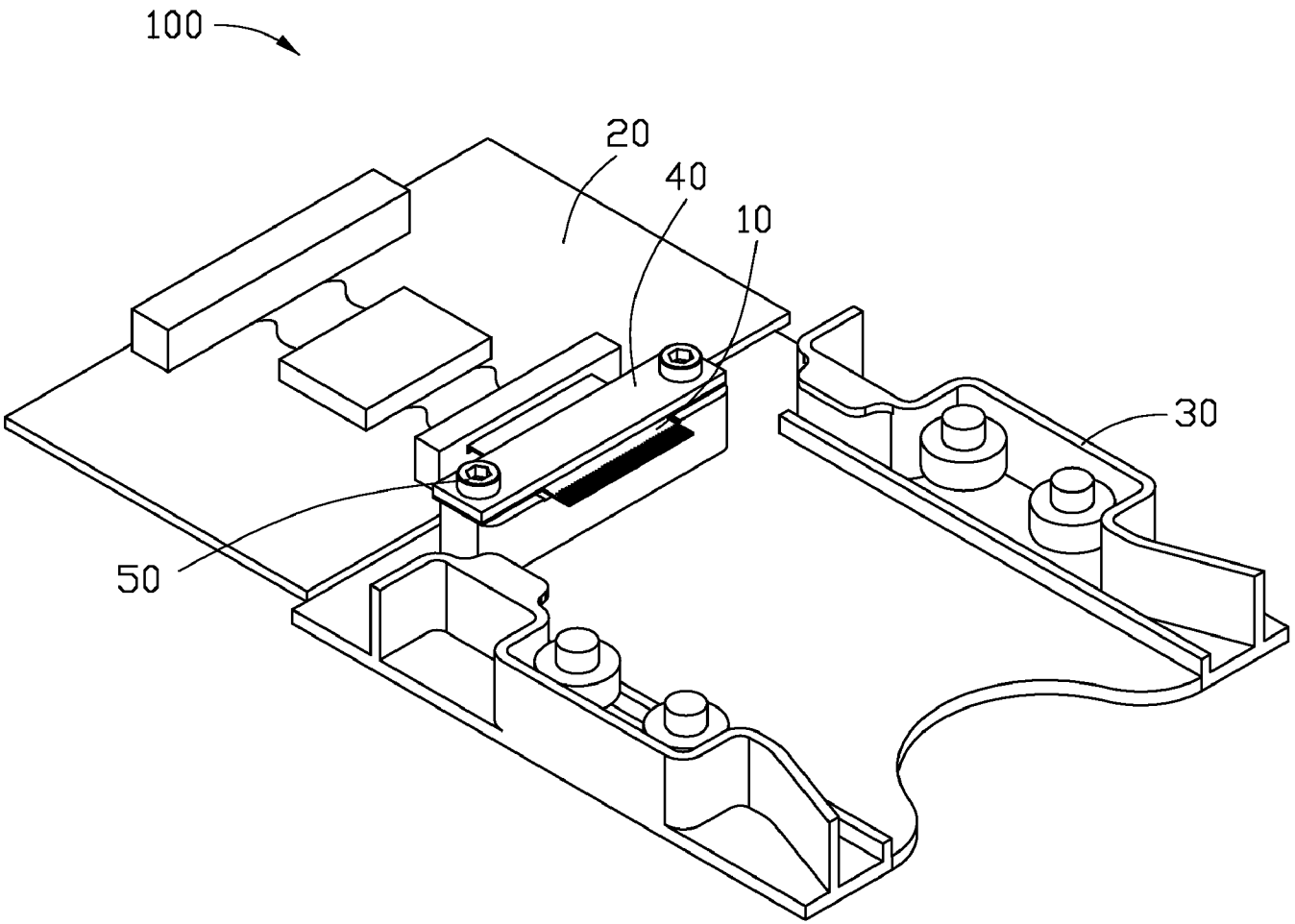
FIG. 1 is an isometric view of an electrical adapter assembly in accordance with an exemplary embodiment, the electrical adapter assembly includes a loading member.
Figure 2:
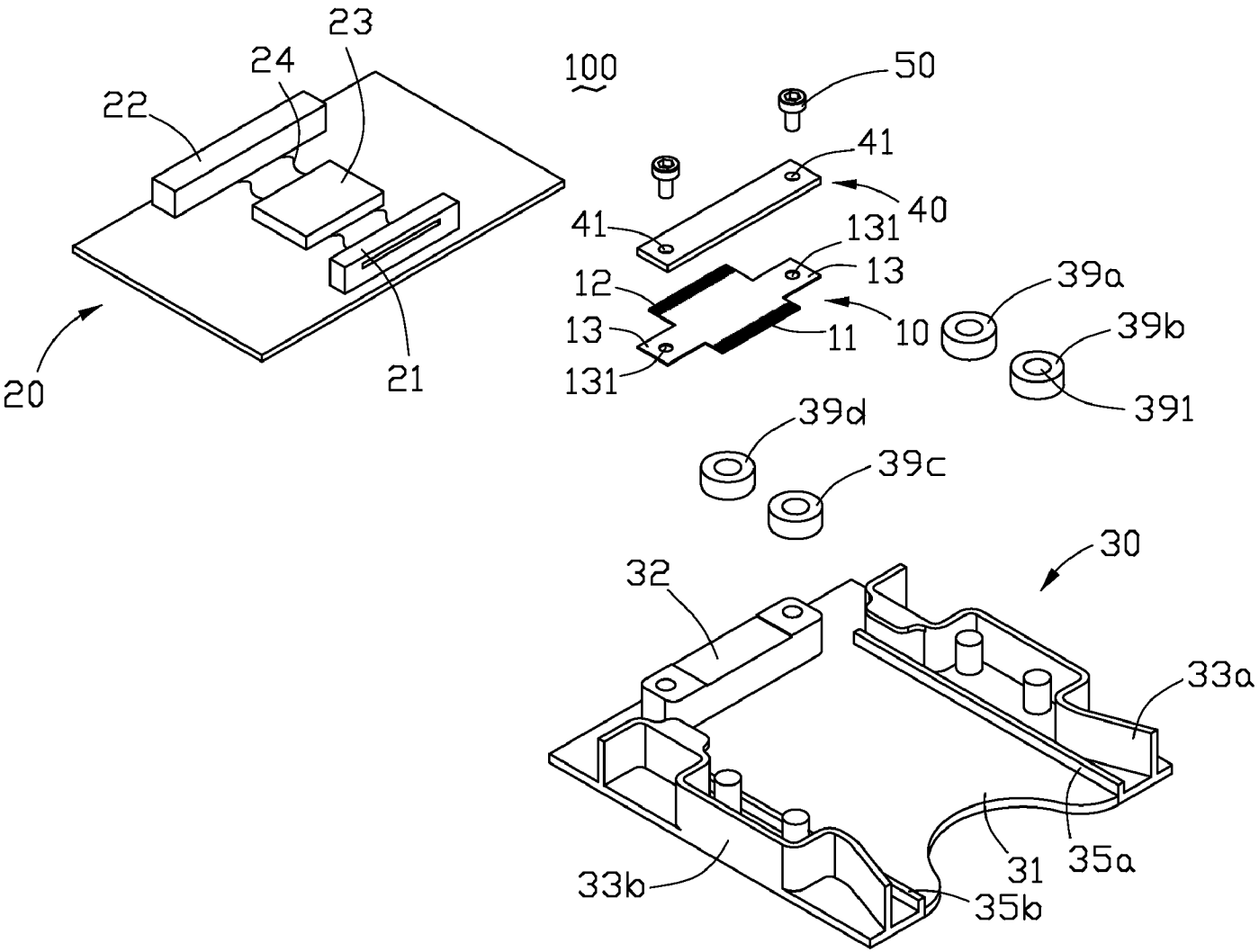
FIG. 2 is an exploded perspective view of the electrical adapter assembly of FIG. 1.
Figure 4:
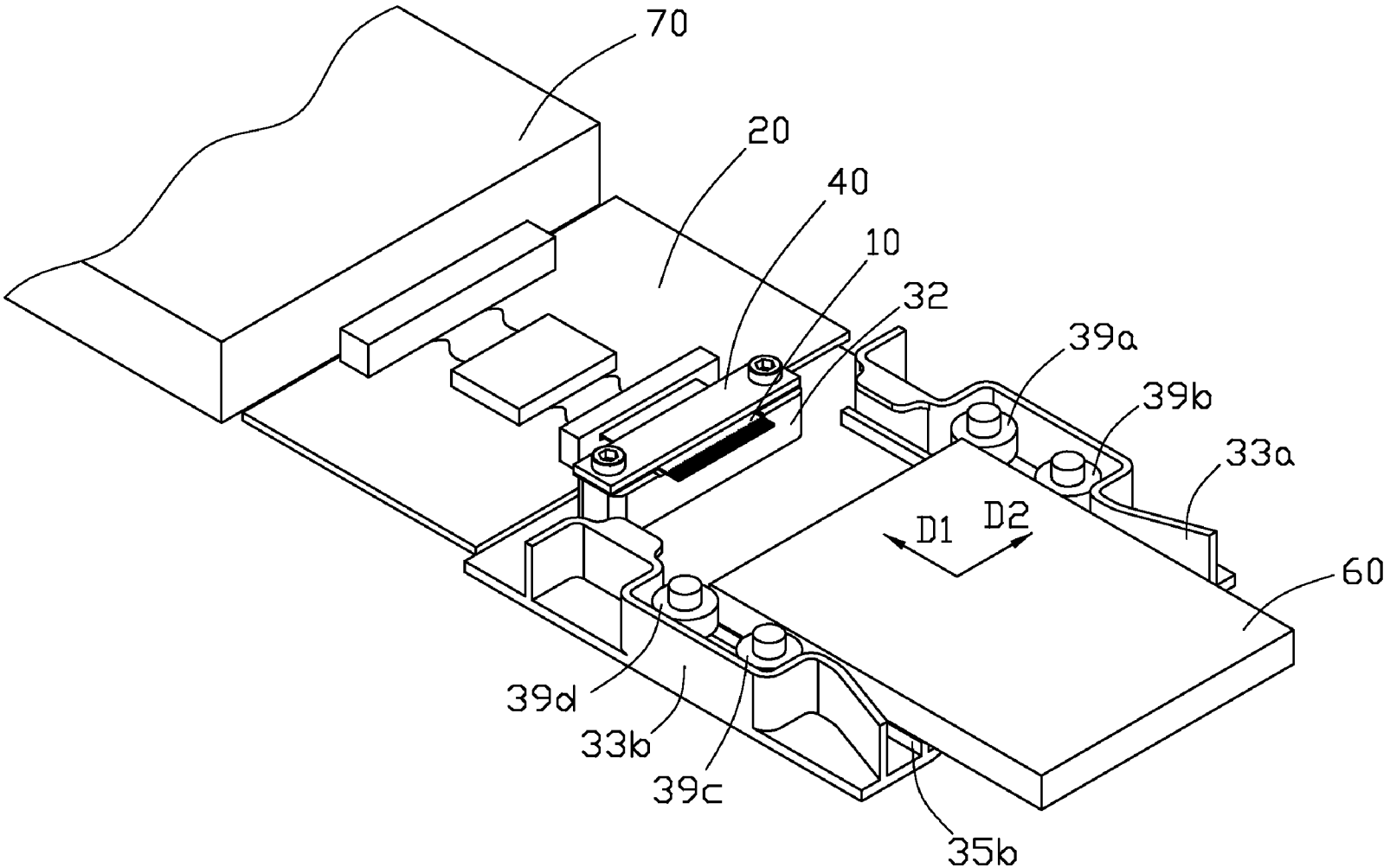
FIG. 4 is an isometric view of the electrical adapter assembly connecting a second hard disk drive and supporting a first hard disk which is about to be connected thereon.

Referring to FIGS. 1 and 2, an electrical adapter assembly 100 in accordance with an exemplary embodiment is configured for electrically connecting a first 1.8 inch hard disk drive 60 (shown in FIG. 4) to a second 3.5 inch hard disk drive 70 (shown in FIG. 4). The electrical adapter assembly 100 includes a connector 10, a printed circuit board (PCB) module 20, a loading member 30, a pressing member 40, and two fixing members 50. The connector 10 is electrically connected with the PCB module 20, and is fastened on the loading member 30 by the pressing member 40 and the fixing members 50.

The connector 10 is a rectangle-shaped printed circuit board. The connector 10 includes 1.8 inch first golden fingers 11, 1.8 inch second golden fingers 12, and two fixing portions 13. The first golden fingers 11 and the second golden fingers 12 are disposed at opposite edges of the connector 10 correspondingly. The two fixing portions 13 are respectively disposed at another two opposite edges of the connector 10. The first golden fingers 11 and the second golden fingers 12 are electrically connected with each other. Each of the fixing portions 13 defines a fixing hole 131.

The PCB module 20 includes a 1.8 inch first socket 21 and a 3.5 inch second socket 22. Each of the first socket 21 and the second socket 22 includes a plurality of pins (not shown). The first socket 21 electrically connects the second golden fingers 12, and the second socket 22 electrically connects to the second hard disk drive 70. The PCB module 20 further includes a chip 23, and circuits 24 for electrically connecting the chip 23 to the first socket 21 and the second socket 22. The chip 23 is used for controlling data transfer between the first hard disk drive 60 and the second hard disk drive 70.

Figure 3:
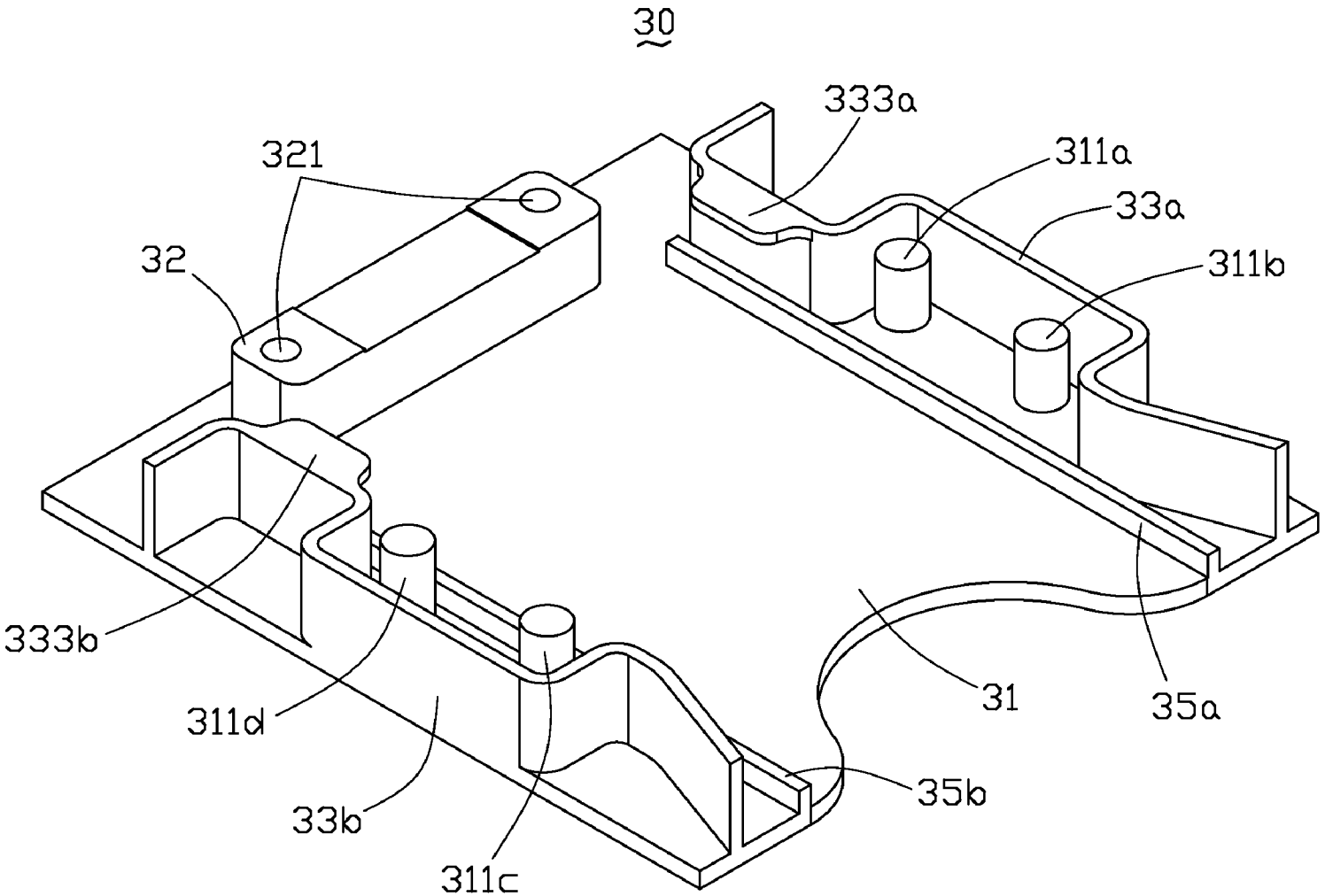
FIG. 3 is an isometric view of the loading member of the electrical adapter assembly of FIG. 1.

The loading member 30 is used for docking the first hard disk drive 60. Referring to FIG. 3, the loading member 30 includes a rectangle-shaped base 31, and a fastening portion 32 extending along one shorter side of the base 31. The base 31 includes four positioning poles 311*a*, 311*b*, 311*c*, 311*d*. The positioning poles 311*a*, 311*b* are arranged on one longer side of the base 31, and the positioning poles 311*c*, 311*d* are arranged on another longer side of the base 31. Two fastening holes 321 are defined in opposite sides of the fastening portion 32. The two fastening holes 321 correspond to the two fixing holes 131 of the connector 10.

The loading member 30 further includes a first guiding wall 33*a*, a second guiding wall 33*b* opposite to the first guiding wall 33*a*, two long narrow-shaped supporting portions 35*a* and 35*b*, and four guiding portions 39*a*, 39*b*, 39*c*, 39*d* (referring to FIG. 4).

The first guiding wall 33*a* and the second guiding wall 33*b* are disposed at the two long sides of the base 31, and curve around the four positioning poles 311*a*, 311*b*, 311*c*, 311*d* correspondingly. The first guiding wall 33*a* includes a stopper 333*a*, and the second guiding wall 33*b* also includes a stopper 333*b*. The stoppers 333*a* and 333*b* extend from top sides of the first guiding wall 33*a* and the second guiding wall 33*b* respectively towards each other. The stoppers 333*a* and 333*b* are adjacent to the fastening portion 32, and parallel with the base 31.

The supporting portions 35*a* and 35*b* extend from the base 31 between the first guiding wall 33*a* and the second guiding wall 33*b* and parallel with the long side of the base 31. The supporting portions 35*a* and 35*b* face the stopper 333*a*, 333*b* respectively, and the supporting portions 35*a* and 35*b* are configured for guiding the first hard disk drive 60 and to decrease contact area between the loading member 30 and the first hard disk drive 60.

Each of the four guiding portions 39*a*, 39*b*, 39*c*, 39*d* has a smooth cylindrical outside surface, and further defines a through hole 391 to allow the four guiding portions 39*a*, 39*b*, 39*c*, 39*d* to be sleeved on the four positioning poles 311*a*, 311*b*, 311*c*, 311*d* respectively.

The pressing member 40 is a flat-shaped board for pressing the connector 10 to the fastening portion 32 of the loading member 30. The pressing member 40 defines two through holes 41 in the board corresponding to the two fixing holes 131 of the connector 10. The two fixing members 50 are inserted through the two through holes 41 and the two fixing holes 131 sequentially, and engage with the two fastening holes 321 correspondingly, so as to fix the connector 10 onto the fastening portion 32 of the loading member 30. The two fixing members 50 may be screws and the two fastening holes 321 may be threaded.

Figure 5:
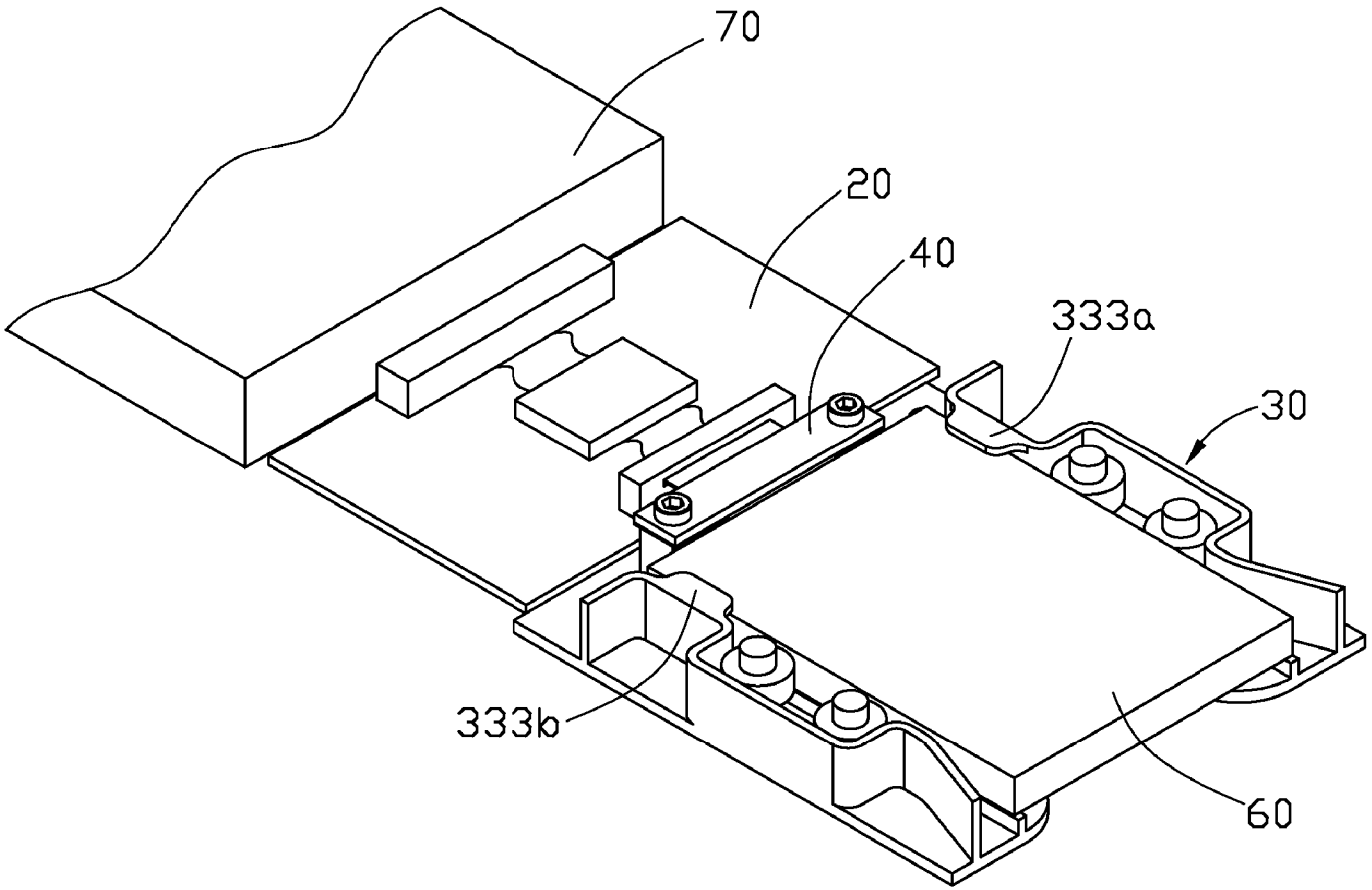
FIG. 5 is an isometric view of the electrical adapter assembly connecting the second hard disk drive to the second hard disk and supporting the first hard disk thereon.

Referring also to FIGS. 4 and 5, in assembly, first, the connector 10 is disposed on the fastening portion 32 of the loading member 30, and the two fixing holes 131 of the connector 10 are aligned with the two fastening holes 321 of the fastening portion 32. Then, the pressing member 40 is disposed on the connector 10, and the two through holes 41 are aligned with the two fixing holes 131 of the connector 10 correspondingly. After that, the two fixing members 50 are correspondingly inserted through the two through holes 41 and the two fixing holes 131, and screwed into the two fastening holes 321 to fix the connector 10 on the fastening portion 32 of the loading member 30. Finally, the second golden fingers 12 are inserted into the first socket 21 to electrically connect the connector 10 to the PCB module 20.

When the electrical adapter assembly 100 is used for connecting the first hard disk drive 60 to the second hard disk drive 70, the first hard disk drive 60 can be disposed between the first guiding wall 33*a* and the second guiding wall 33*b* and supported by the supporting portions 35*a*, 35*b*. And then, the first hard disk drive 60 is pushed along a first direction D1, such that, opposite side surfaces of the first hard disk drive 60 contact the guiding portions 39*a*, 39*b* and the guiding portions 39*c*, 39*d* correspondingly and movement along a second direction D2 substantially perpendicular to the first direction D1 limited, and apply a frictional force to the guiding portions 39*a*, 39*b*, 39*c*, 39*d* to allow the guiding portions 39*a*, 39*b*, 39*c*, 39*d* to rotate around the four positioning poles 311*a*, 311*b*, 311*c*, 311*d* respectively. Finally, the one end of the first hard disk drive 60 slides under the two stopper 333*a* and 333*b*, the first golden fingers 11 are inserted into a hard disk connector (not shown) of the first hard disk drive 60. The second socket 22 of the PCB module 20 can be inserted into a hard disk connector (not shown) of the second hard disk drive 70.

Therefore, the electrical adapter assembly 100 electrically connects the first hard disk drive 60 to the second hard disk drive 70, thereby the first and second hard disk drives 60, 70 can transfer data between each other under control of the chip 23 of the PCB module 20. Because the guiding portions 39*a*, 39*b*, 39*c*, 39*d* are rotatably disposed on the positioning poles 311*a*, 311*b*, 311*c*, 311*d* respectively, the first hard disk drive 60 will be protected from wear and tear due to sliding between the guiding portions 39*a*, 39*b*, 39*c*, 39*d*. In addition, the two stoppers 333*a*, 333*b*, the supporting portions 35*a*, 35*b*, may cooperately prevent the first hard disk drive 60 from falling out of the base 31 in the up-down direction.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An electrical adapter assembly for connecting a first hard disk drive and a second hard disk drive, the electrical adapter assembly comprising:

a connector capable of electrically inserting into the first hard disk drive;

a printed circuit board module electrically connecting the connector, the printed circuit board module comprising at least one chip for controlling data transfer between the first hard disk drive and the second hard disk drive; and a loading member for loading the first hard disk drive, comprising:

a base; and at least two guiding portions rotatably attached on the base to allow the first hard disk drive to be able to slide between the at least two guiding portions.

2. The electrical adapter assembly as claimed in claim 1, wherein a supporting portion protrudes from the base between the at least two guiding portions to decrease a contact area between the base and the first hard disk drive.

3. The electrical adapter assembly as claimed in claim 2, wherein the supporting portion is elongated.

4. The electrical adapter assembly as claimed in claim 1, wherein the loading member further comprises at least two positioning poles for engaging with the at least two guiding portions.

5. The electrical adapter assembly as claimed in claim 1, wherein the loading member further comprises two guiding walls, and each of the guiding walls comprises a stopper facing the base for preventing the first disk drive from detaching from the loading member.

6. The electrical adapter assembly as claimed in claim 1, wherein the connector is embodied in a printed circuit board.

7. The electrical adapter assembly as claimed in claim 6, wherein the connector comprises a first golden fingers capable of electrically inserting into the first hard disk drive, and a second golden fingers electrically connecting to the first golden fingers, and the printed circuit board module further comprises a first socket electrically connecting the printed circuit board module to the second golden fingers, a second socket capable of electrically inserting into the second hard disk drive, and circuits connecting the at least chip to first socket and the second socket.

8. The electrical adapter assembly as claimed in claim 6, wherein the connector is fixed on the loading member, and a fastening portion protrudes from the loading member for supporting the connector.

9. The electrical adapter assembly as claimed in claim 8, wherein the fastening portion defines a fastening hole, the connector defines a fixing hole corresponding to the fastening hole, a fixing member passes through the fixing hole and engages with the fastening hole to fix the connector to the fastening portion.

10. The electrical adapter assembly as claimed in claim 9, further comprising a pressing member for pressing the connector.

11. The electrical adapter assembly as claimed in claim 1, wherein each of the guiding portions has cylindrical outside surface.

12. The electrical adapter assembly as claimed in claim 1, wherein the first hard disk drive is 1.8 inch, and the second hard disk drive is 3.5 inch.

13. A loading member for removably loading a hard disk drive, the loading member comprising:

a first connector detachably fixed to the loading member for coupling to the hard disk drive;

at least one supporting portion for supporting the hard disk drive thereon and guiding the hard disk drive to be pushed along a first direction; and a pair of guiding portions rotatably contacting with two sides of the hard disk drive during the hard disk being pushed along the first direction, and movements of the hard disk drive along a second direction substantially perpendicular to the first direction limited.

14. The loading member as claimed in claim 13, further comprising two guiding walls, each of the guiding walls comprising a stopper extending opposite to each other along the second direction for clamping the hard disk drive between the at least one supporting portion and the stopper.

* * * * *